US006321553B1

(12) United States Patent
Bushnell et al.

(10) Patent No.: US 6,321,553 B1
(45) Date of Patent: Nov. 27, 2001

(54) AIR CONDITIONER STRUCTURE

(75) Inventors: Peter R. Bushnell, Cazenovia, NY (US); Nestor Hernandez, Nuevo Leon (MX); Juan C. C. Correa, Porto Alegre (BR); Werner Adomeit, Liverpool, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/641,234

(22) Filed: Aug. 17, 2000

(51) Int. Cl.[7] ..... F25D 23/12
(52) U.S. Cl. ..... 62/262; 62/298
(58) Field of Search ..... 62/262, 298, 259.1; 312/101

(56) References Cited

U.S. PATENT DOCUMENTS

| | | | | |
|---|---|---|---|---|
| 4,977,750 | * | 12/1990 | Metcalfe | 62/77 |
| 5,203,400 | * | 4/1993 | Tsunekawa et al. | 165/59 |
| 6,182,460 | * | 2/2001 | Hernandez et al. | 62/262 |
| 6,205,804 | * | 3/2001 | Da Silva | 62/262 |

* cited by examiner

*Primary Examiner*—Henry Bennett
*Assistant Examiner*—Melvin Jones

(57) ABSTRACT

An improved room air conditioner of the type assembled from a first subassembly, which includes a basepan having an indoor region proximate the front of the basepan and an outdoor region proximate the back of the basepan. A compressor, a condenser coil, an evaporator coil, and a refrigeration flow circuit are all included in the first subassembly. A second subassembly includes a vertically extending partition having an indoor side, an outdoor side and an opening therein extending from the indoor side to the outdoor side. The partition is configured to cooperate with the basepan to separate the indoor region from the outdoor region. The second subassembly includes an electric motor mounted on the partition, which is adapted to drive an indoor fan and an outdoor fan. The first and second subassemblies are configured such that they may be assembled separate from one another and may be assembled to one another by the positioning of the second subassembly in a position vertically spaced above the subassembly and lowering the second subassembly into a predetermined alignment with the first subassembly with the partition engaging the basepan. The partition is provided with a vertically extending lower portion defining a lower edge. The basepan defines a lower wall having formed therein an upstanding structural wall, configured to receive the lower portion of the partition in confronting relation therewith with the lower edge of the partition in contact with the lower wall.

6 Claims, 14 Drawing Sheets

AIR CONDITIONER STRUCTURE

BACKGROUND OF THE INVENTION

The present invention is directed to air conditioners and, more particularly, to the assembly of window room air conditioning units.

Air conditioning units such as so-called "window room air conditioners" are commonly used for residential and similar applications and generally include closed refrigeration circuits having an evaporator and a condenser. The unit is normally divided by a partition into an evaporator section and a condenser section. The evaporator section communicating with the room air to be conditioned and the condenser section communicating with external air such as outdoor air. Refrigerant flows through a refrigerant circuit absorbing heat from the room air at the evaporator and discharging heat energy to the external air at the condenser. The conventional refrigeration circuit is completed by the addition of a compressor, an expansion device, and the appropriate connections between the components.

Such an air conditioning unit usually includes a basepan supporting all of the components and an outer housing surrounding the entire unit. The front of the evaporator, or indoor section, includes an indoor grille, which has openings therein for directing warm indoor air into the evaporator and discharge openings therein for directing air back into the room. The outdoor section of the housing includes a plurality of openings in the sides and top thereof, which serve as inlet openings for cooling air which flows into the outdoor section and outwardly therefrom after passing through the condenser coil, which is mounted vertically in the back of the outdoor section.

In addition to the components mentioned above, the outdoor section also typically includes an outdoor fan and fan shroud, as well as an electric motor, which typically also drives an indoor fan. The indoor section also typically includes the aforementioned indoor fan, an indoor fan orifice, a control box as well as a fan scroll structure for directing the air cooled by the evaporator back into the room to be cooled. Each of the aforementioned components requires means for attaching it to the basepan and/or other structure of the air conditioning unit. Numerous approaches are known for assembly of the components of such units. However, it is desirable to design a unit which may be assembled in a manner which will minimize the total number of individual components in the unit. The fewer components and the fewer number of attachment means results in lower material costs, less labor content and, accordingly, a less expensive unit.

U.S. patent application Ser. No. 09/140,007 entitled "Window Room Air Conditioner" is directed to a room air conditioner of the type having an indoor section and an outdoor section, which are supported by a basepan and which are separated by a partition. The indoor section includes an indoor fan and an evaporator coil, and the outdoor section includes a condenser coil, an outdoor fan and a compressor. The '007 application comprises a first subassembly, which includes a basepan having an indoor region proximate the front of the basepan and an outdoor region proximate the back of the basepan. The first subassembly further includes a compressor supported in the outdoor region and a condenser coil supported in the outdoor region rearwardly of the compressor. An evaporator coil is supported in the indoor region and a refrigeration flow circuit connects the condenser coil, the evaporator coil, and the compressor. A second subassembly includes a vertically extending partition having an indoor side, an outside and an opening therethrough extending between the sides. The partition is configured to cooperate with the basepan when the first and second subassemblies are assembled to one another to separate the indoor region from the outdoor region. The second subassembly includes an electric motor mounted on the outdoor side of the partition. The motor has a drive shaft extending perpendicular to the partition with the first end extending through the opening so that it is on the indoor side of the partition and the second end on the outdoor side of the partition. An indoor fan is mounted to the first end of the drive shaft and an outdoor fan is mounted to the second end of the drive shaft.

The first and second subassemblies are each configured such that they may be assembled separate from one another and such that the second subassembly may be assembled to the first subassembly by positioning the second subassembly in a position vertically spaced above the first subassembly and, thereby lowered into a predetermined alignment with the first subassembly with the outdoor fan forward of and adjacent to the outdoor heat exchanger, and the indoor fan rearward of and spaced from the indoor heat exchanger and the partition engaging and attached to the basepan.

SUMMARY OF THE INVENTION

An improved room air conditioner of the type assembled from a first subassembly, which includes a basepan having an indoor region proximate the front of the basepan and an outdoor region proximate the back of the basepan. A compressor, a condenser coil, an evaporator coil, and a refrigeration flow circuit are all included in the first subassembly. A second subassembly includes a vertically extending partition having an indoor side, an outdoor side and an opening therein extending from the indoor side to the outdoor side. The partition is configured to cooperate with the basepan to separate the indoor region from the outdoor region. The second subassembly includes an electric motor mounted on the partition, which is adapted to drive an indoor fan and an outdoor fan. The first and second subassemblies are configured such that they may be assembled separate from one another and may be assembled to one another by the positioning of the second subassembly in a position vertically spaced above the subassembly and lowering the second subassembly into a predetermined alignment with the first subassembly with the partition engaging the basepan. The partition is provided with a vertically extending lower portion defining a lower edge. The basepan defines a lower wall having formed therein an upstanding structural wall, configured to receive the lower portion of the partition in confronting relation therewith with the lower edge of the partition in contact with the lower wall.

In a preferred embodiment, the upstanding structural wall section has associated therewith one or more vertically extending guide tabs configured to engage lower edges of the partition when the partition is being assembled to the basepan to guide the lower portion of the partition into confronting engagement with the lower wall sections.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENTS

Figure 1:
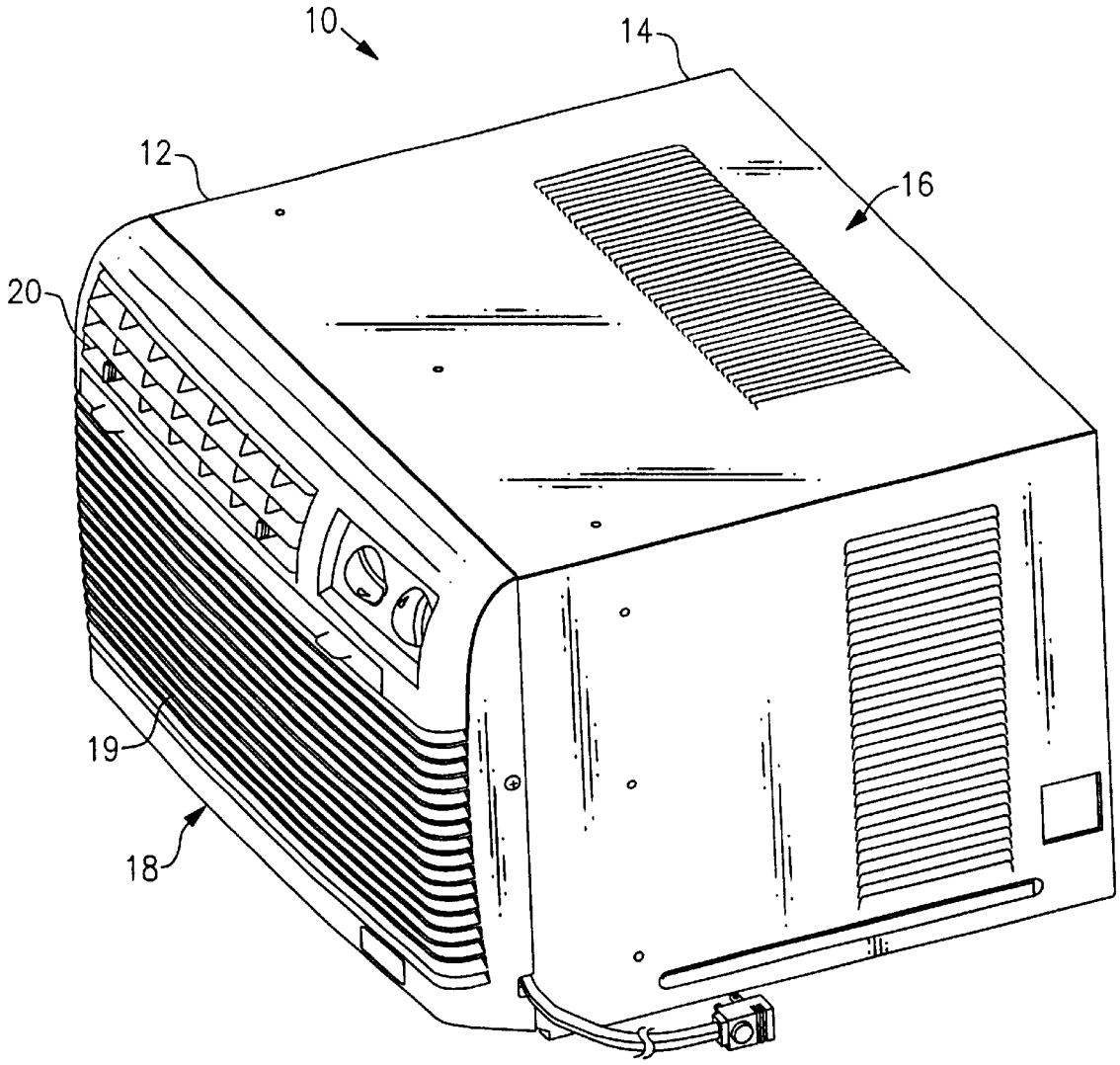
FIG. 1 is a perspective view of a room air conditioner, which embodies the features of this invention.

FIG. 1 illustrates a room air conditioner unit 10 which includes generally an indoor section 12 and an outdoor section 14. The air conditioner is enclosed in a substantially rectangular housing 16 and is adapted to be positioned in a rectangular opening in an exterior wall or in a window in a room where cooling is desired, with the indoor section 12 facing into the room, as is conventional. The indoor section 12 includes an indoor grille section 18, which includes inlet louvers 19 and an air discharge assembly 20.

Figure 2:
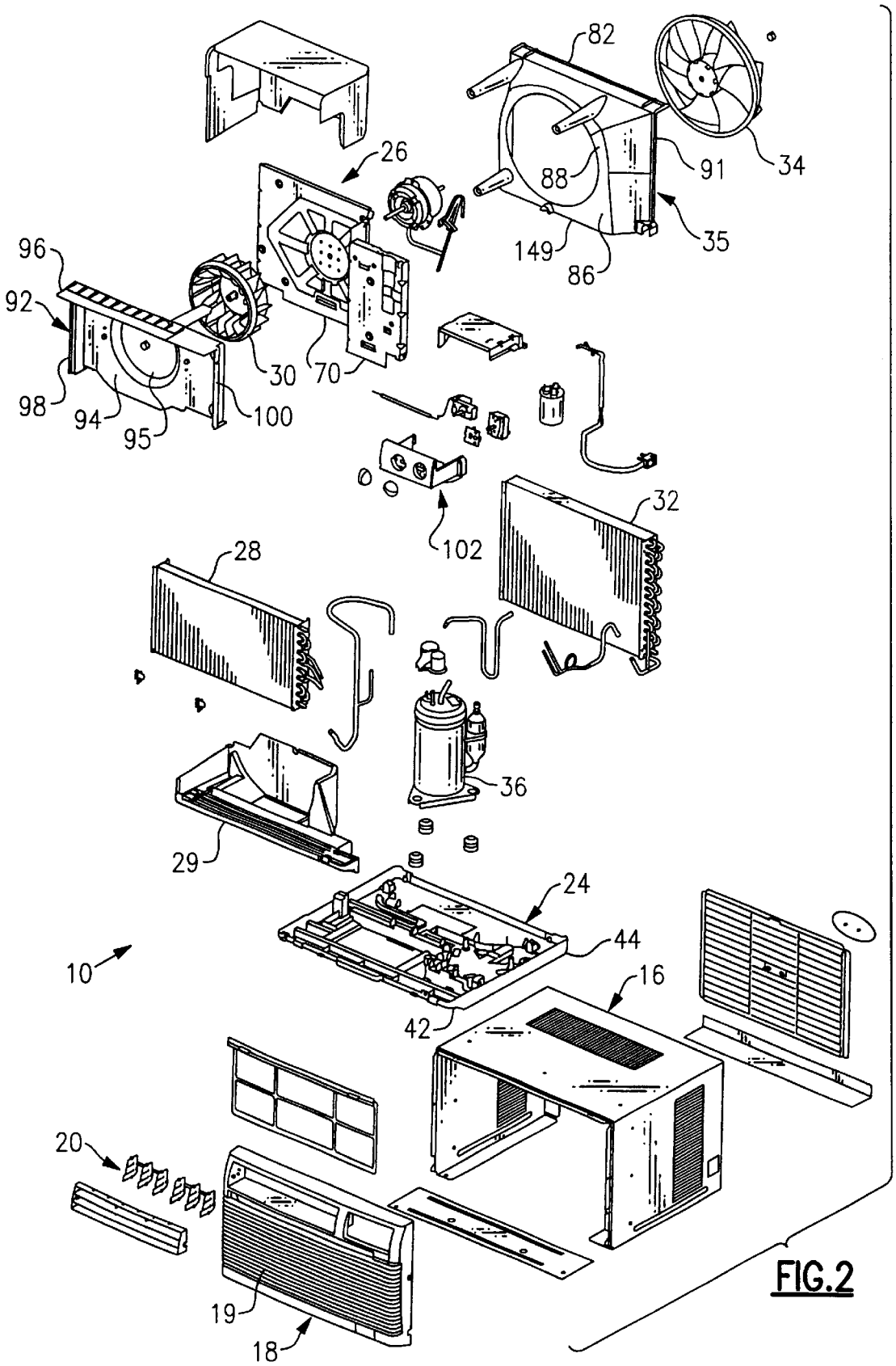
FIG. 2 is an exploded view of the air conditioner illustrated in FIG. 1.
Figure 15:
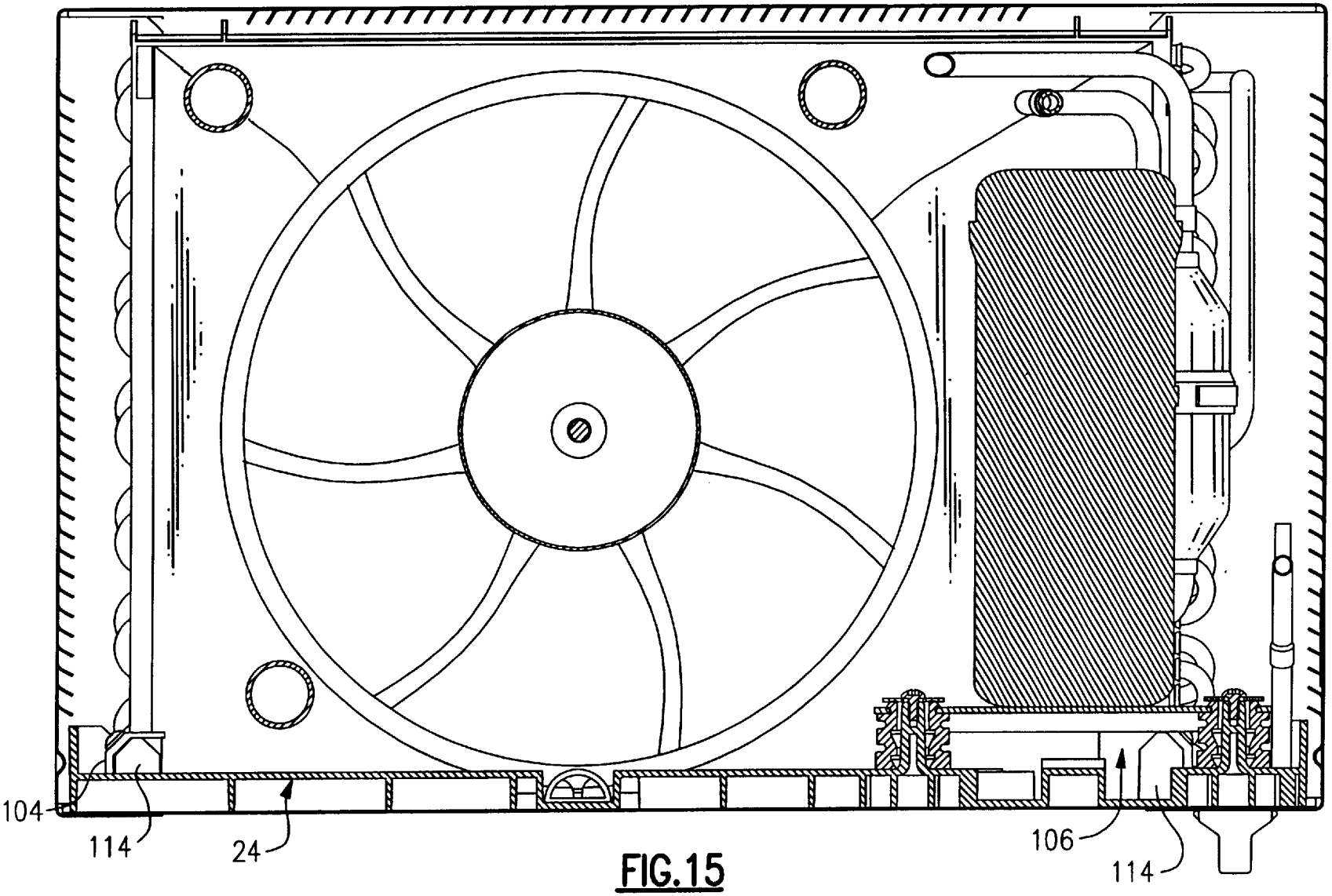
FIG. 15 is a front sectional view taken just forward of the condenser fan to illustrate details of the present invention.

Looking now at FIGS. 2 and 15, the components of both the indoor section 12 and outdoor section 14 are supported in a rectangular basepan 24. The indoor and outdoor sections are separated by a vertically extending metal partition 26. The indoor section comprises basically an evaporator coil 28 vertically disposed at the front end thereof, an evaporator or indoor fan 30 located behind the evaporator 28 and an air directing scroll 29.

The outdoor section 14 includes a condenser coil 32 vertically disposed adjacent the back end thereof, a condenser fan 34, located adjacent the condenser coil, and a fan orifice structure 35. The unit's compressor 36 is also located in the outdoor section 14. The condenser coil 32 is fluidly interconnected with the compressor 36 and the evaporator 28 in a conventional manner to provide cooling to the room in which the unit is installed.

During operation, air from the space to be conditioned by the unit is drawn by action of the evaporator fan 30 through the inlet louvers 19 and is directed through the evaporator coil 28 where the air is cooled. The cooled air is then directed by the scroll 29 back into the room to be cooled through the air discharge assembly 20. At the same time, ambient air is drawn through inlets 37 in the outside section of the housing 16 and through the orifice structure 35, by operation of the condenser fan 34, and is directed through the condenser coil 32 before exiting from the backside of the condenser coil.

Figure 3:
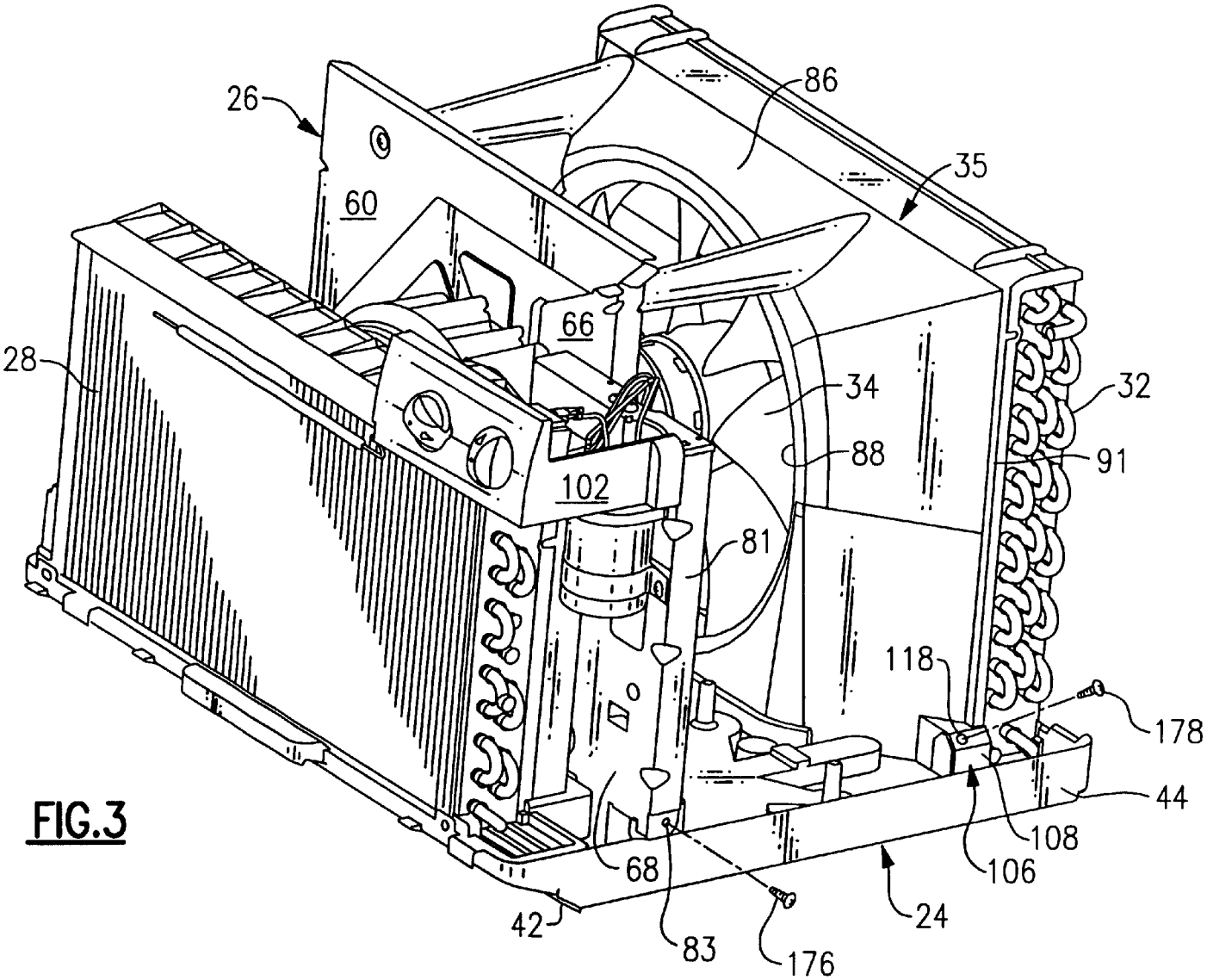
FIG. 3 is a perspective view of the air conditioner illustrated in FIG. 1 with the outer housing and grille and certain internal components removed therefrom in order to show details of the present invention.
Figure 4:
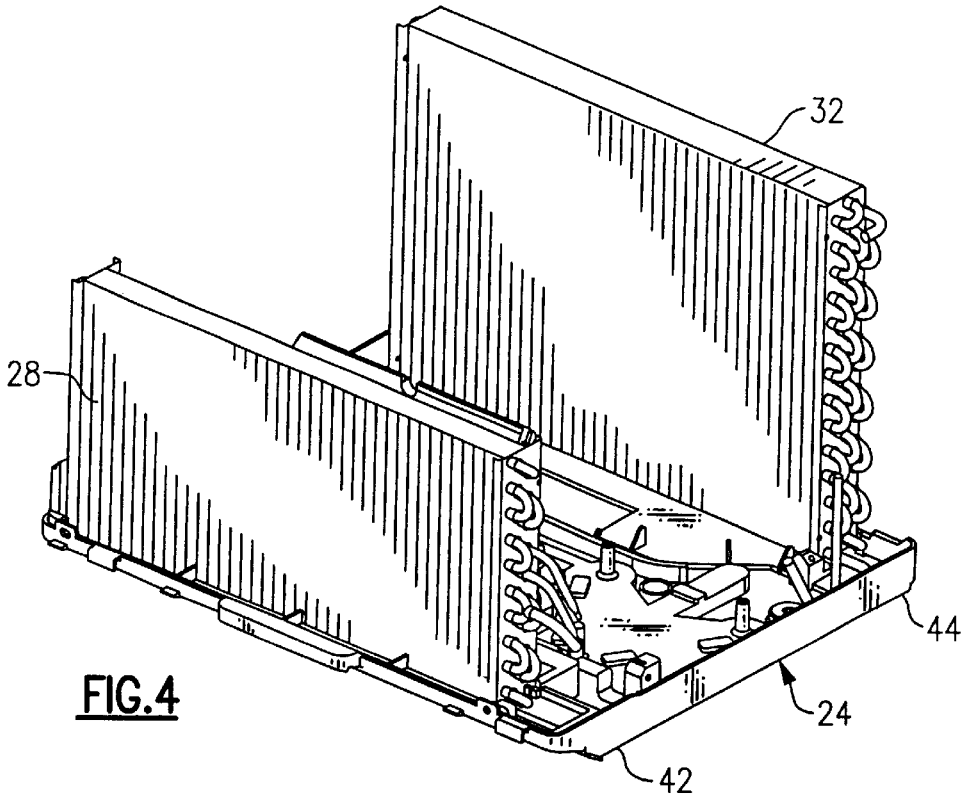
FIG. 4 is a front perspective view of the air conditioner as illustrated in FIG. 3 with other components removed therefrom.
Figure 5:
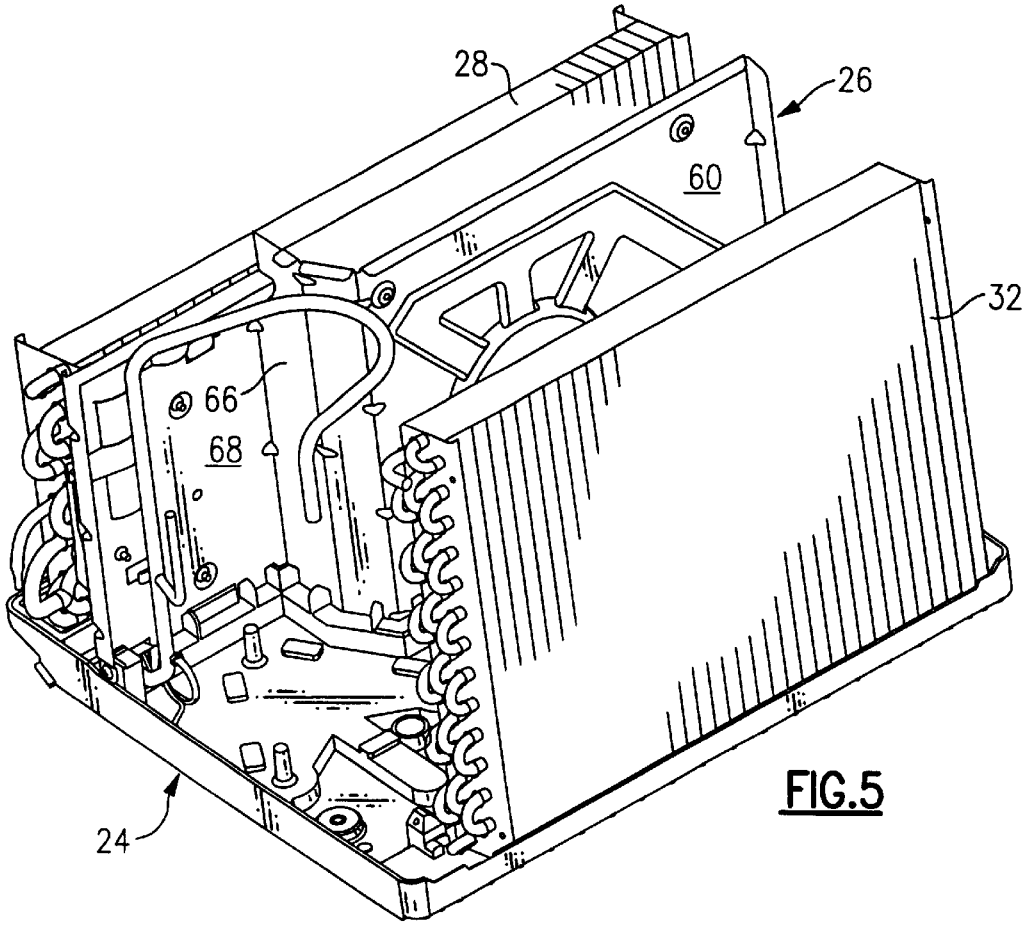
FIG. 5 is a rear view of the air conditioner illustrated in FIG. 3 with certain other components removed therefrom to show details of the invention.
Figure 6:
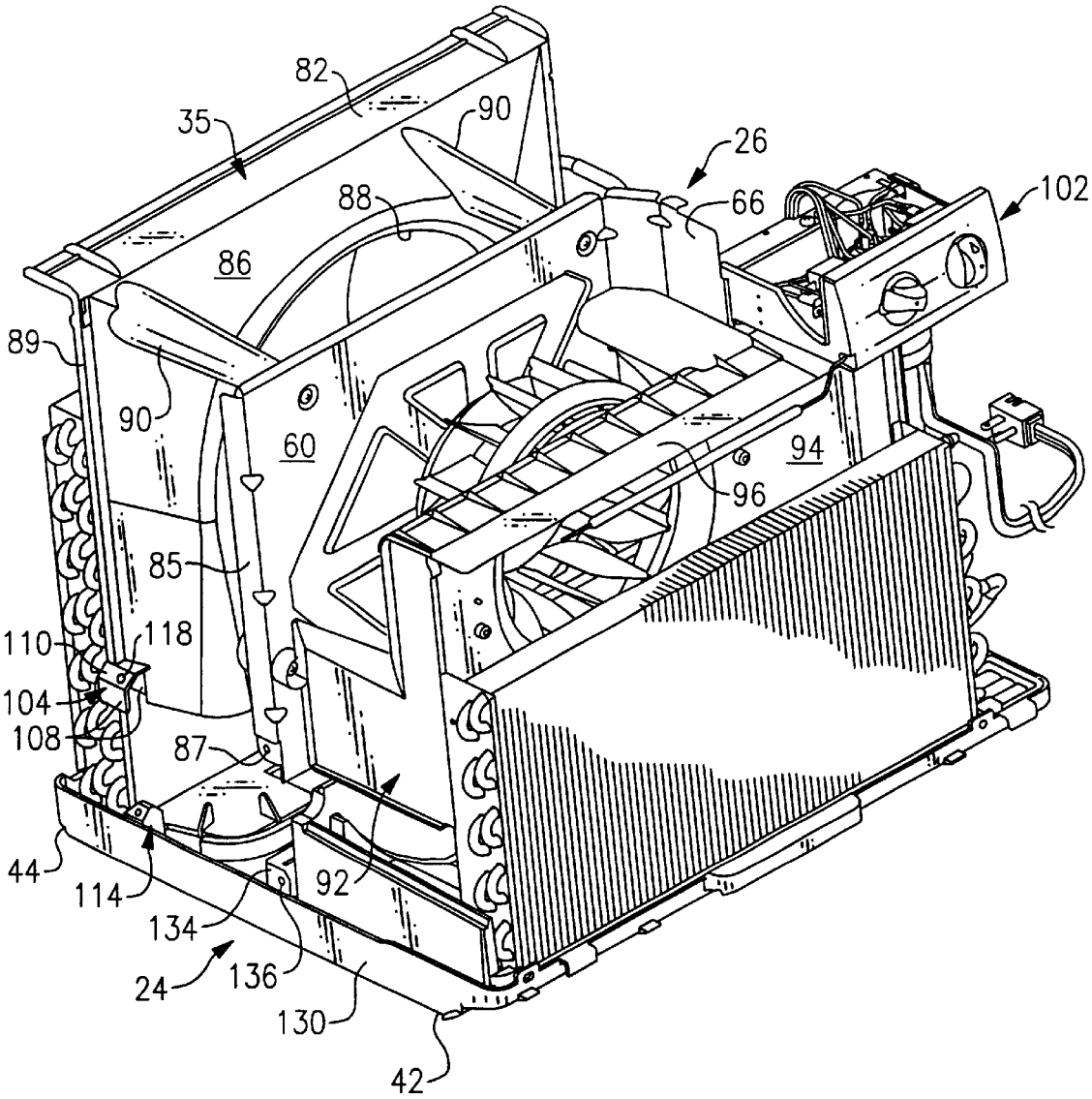
FIGS. 6, 7 and 8 are each perspective views illustrating from three different angles the relative positions of the first and second subassemblies during assembly to one another and illustrating details of the present invention.
Figure 7:
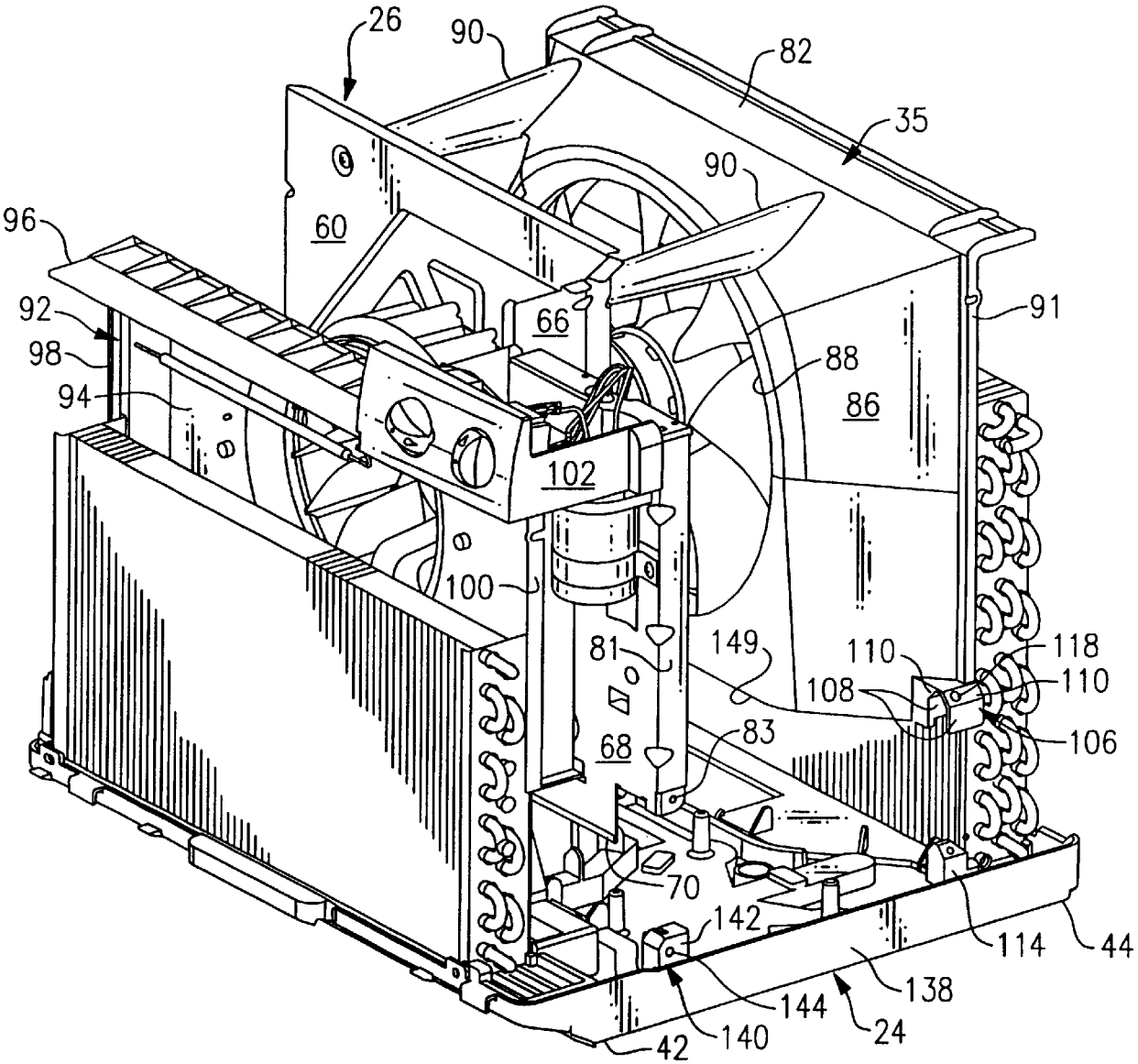
Figure 8:
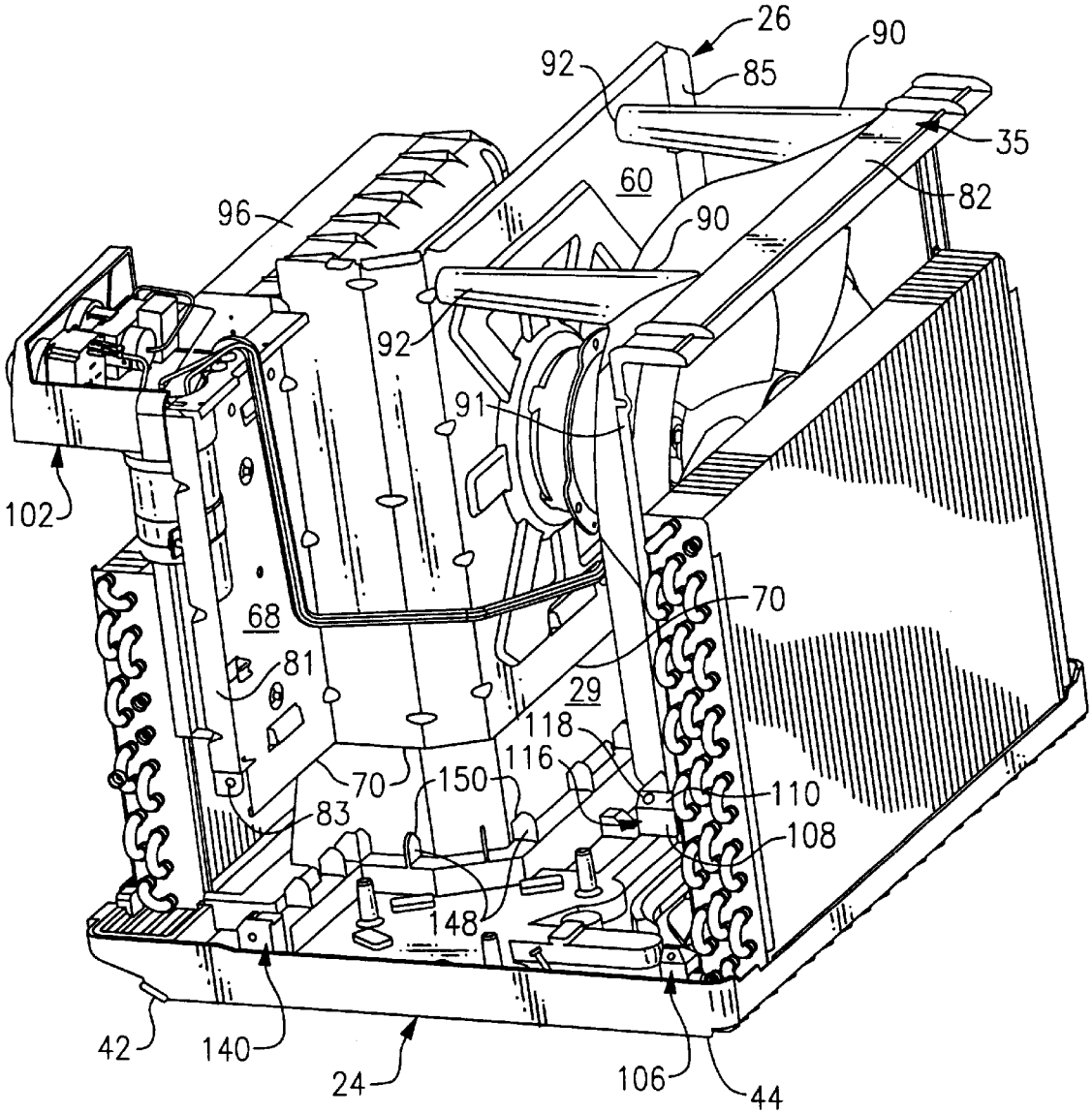

As described in the previously referenced U.S. patent application Ser. No. 09/140,007, which application is hereby incorporated herein in its entirety by reference thereto, all of the components of the air conditioning unit 10 which are contained within the housing 16 and the indoor grille 18 are assembled in two major subassemblies, which are then easily assembled to one another prior to installation of the housing 16 and the indoor grille 18 to complete assembly of the unit. FIGS. 6–8 illustrate the two major subassemblies, which will hereinafter be referred to with reference to their relative positions as illustrated in those Figures, which are their positions during assembly to one another. Accordingly, reference numeral 38 refers to the upper subassembly and reference numeral 40 refers to the lower subassembly, as illustrated in FIGS. 6–8. As will be seen, FIG. 3 illustrates the result of the assembly of the upper subassembly 38 to the lower subassembly 40.

Looking specifically now at FIGS. 6–8, and with further reference to FIG. 2 and the other drawing figures, the lower subassembly 40 comprises the previously described basepan 24, which has an indoor region 42 proximate the front of the basepan and an outdoor region 44 proximate the back of the basepan. The first component installed in the indoor region 42 of the basepan is a lower portion 46 of the scroll 29. The lower scroll section 46 is made from a molded polystyrene foam material and includes a condensate drain pan section 48 and a vertically extending wall section 50, which forms the lower part of the scroll assembly. This component is illustrated in detail in FIGS. 10 and 11. The evaporator coil 28 is positioned with its lower end supported by the condensate drain pan 48.

Following this, the condenser coil 32 is positioned in the backside of the outdoor region 44 of the basepan, as shown. The compressor 36 is then appropriately attached as illustrated in the drawing figures to the basepan in the outdoor region 44 through appropriate attachment hardware, including mounting studs and vibration isolating bushings 54. The condenser coil 32, the compressor 36, and the evaporator coil 28 are then appropriately interconnected to one another by refrigerant tubing generally 56, including a capillary tube expansion device 58, as is conventional. Following such assembly, the refrigeration system may be evacuated and charged with refrigerant and is ready for installation of the upper subassembly 38 thereto.

Figure 10:
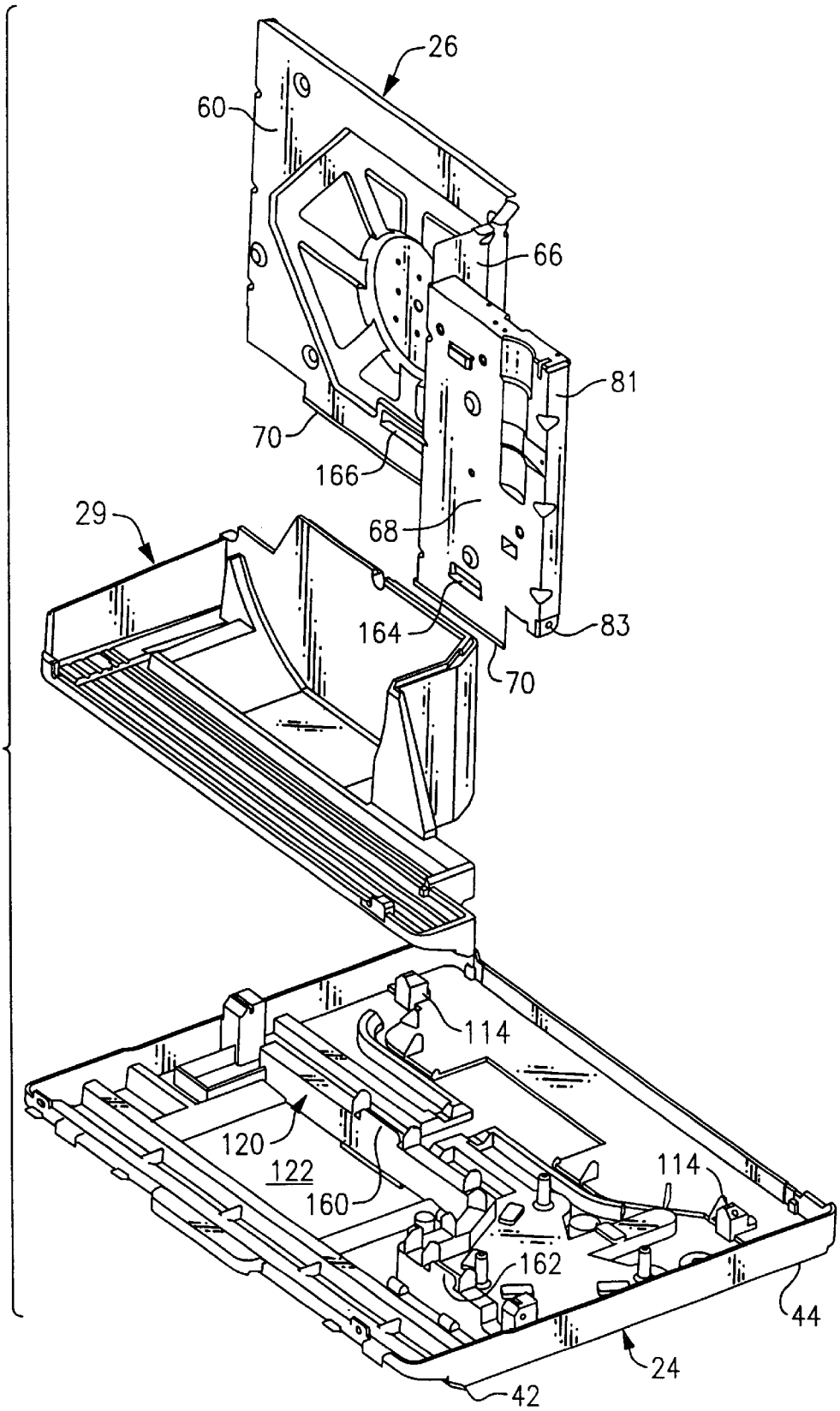
FIG. 10 is an exploded perspective view of the basepan, front scroll and partition of the air conditioner of FIG. 1.
Figure 11:
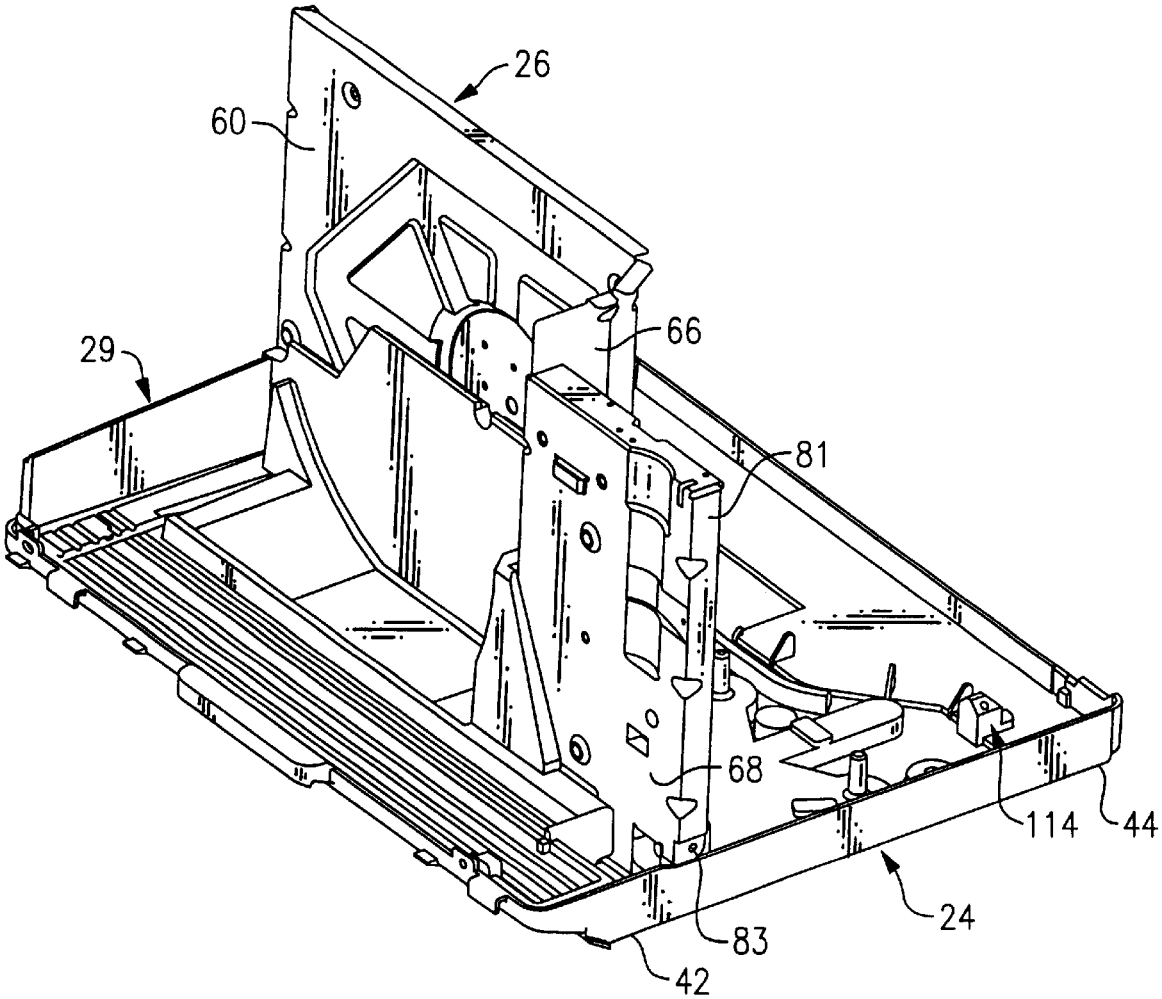
FIG. 11 is illustrates the components of FIG. 9 assembled to one another.
Figure 12:
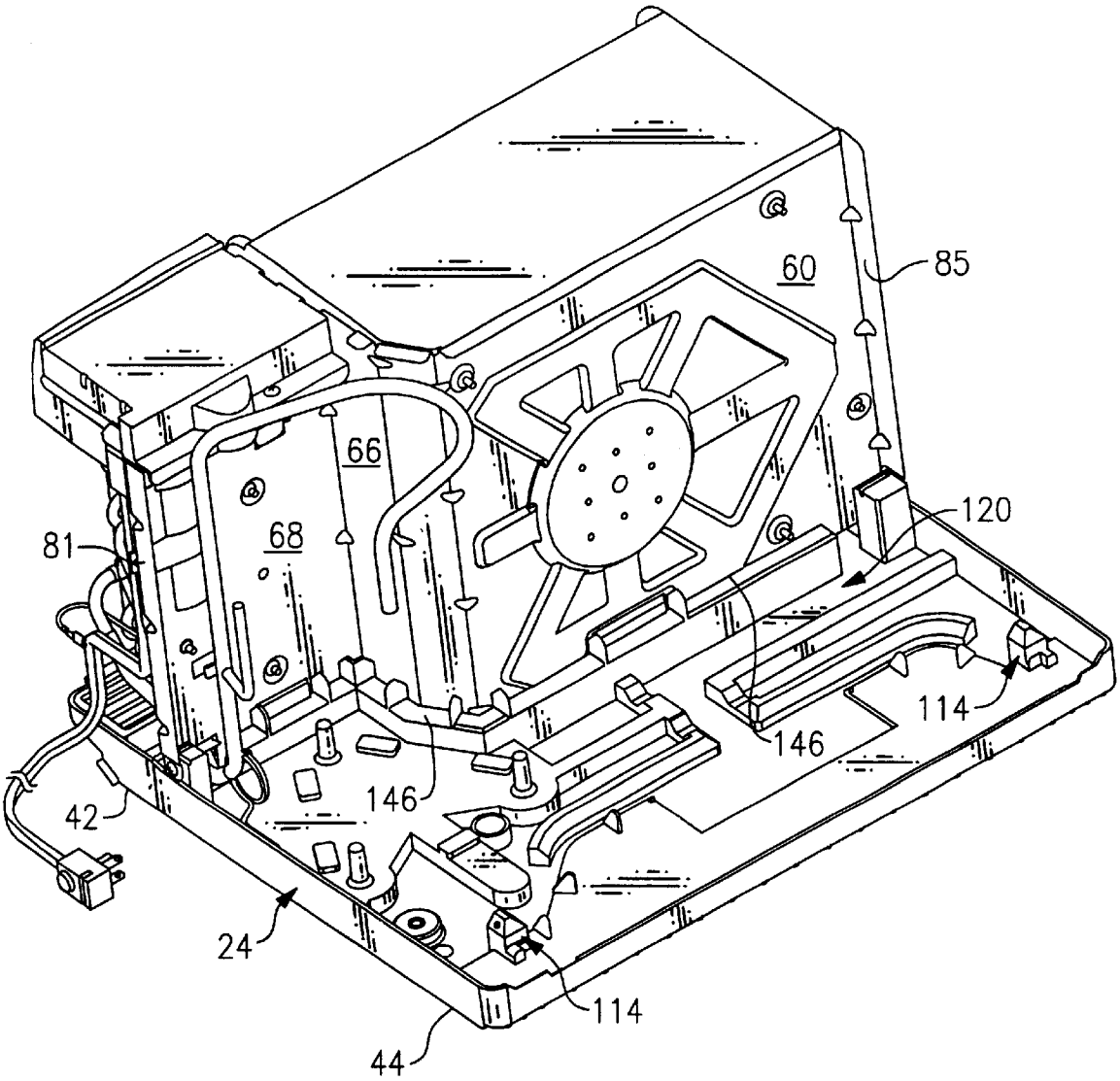
FIG. 12 is a rear perspective view of the air conditioner of FIG. 1 with a number of components removed to show details of the invention.

Looking now at the upper subassembly 38, FIGS. 2, 10 and 11 illustrate details of the metal partition 26, to which all of the other components of the upper subassembly are attached. The partition is fabricated from galvanized sheet steel and comprises a major planar section 60 having a centrally located circular recess 62 formed therein which has a centrally located circular opening 64 extending therethrough. Extending forwardly from the right-hand edge of the planar section 60 is an intermediate section 66 from which a second smaller planar section 68 extends. Each of the planar sections 60, 66 and 68 include, at the lower ends thereof, short sections which are bent upwardly to overlap the planar sections to form double thickness reinforced ribs presenting rounded downwardly facing edges 70. The right side of the partition 26 has a vertically extending rearwardly facing flange 81 found thereon which has an opening 83 at the lower end thereof. In a like manner, the left side of the partition also has a vertically extending rearwardly facing flange 85, which also has an opening 87 at the lower end thereof.

Figure 14:
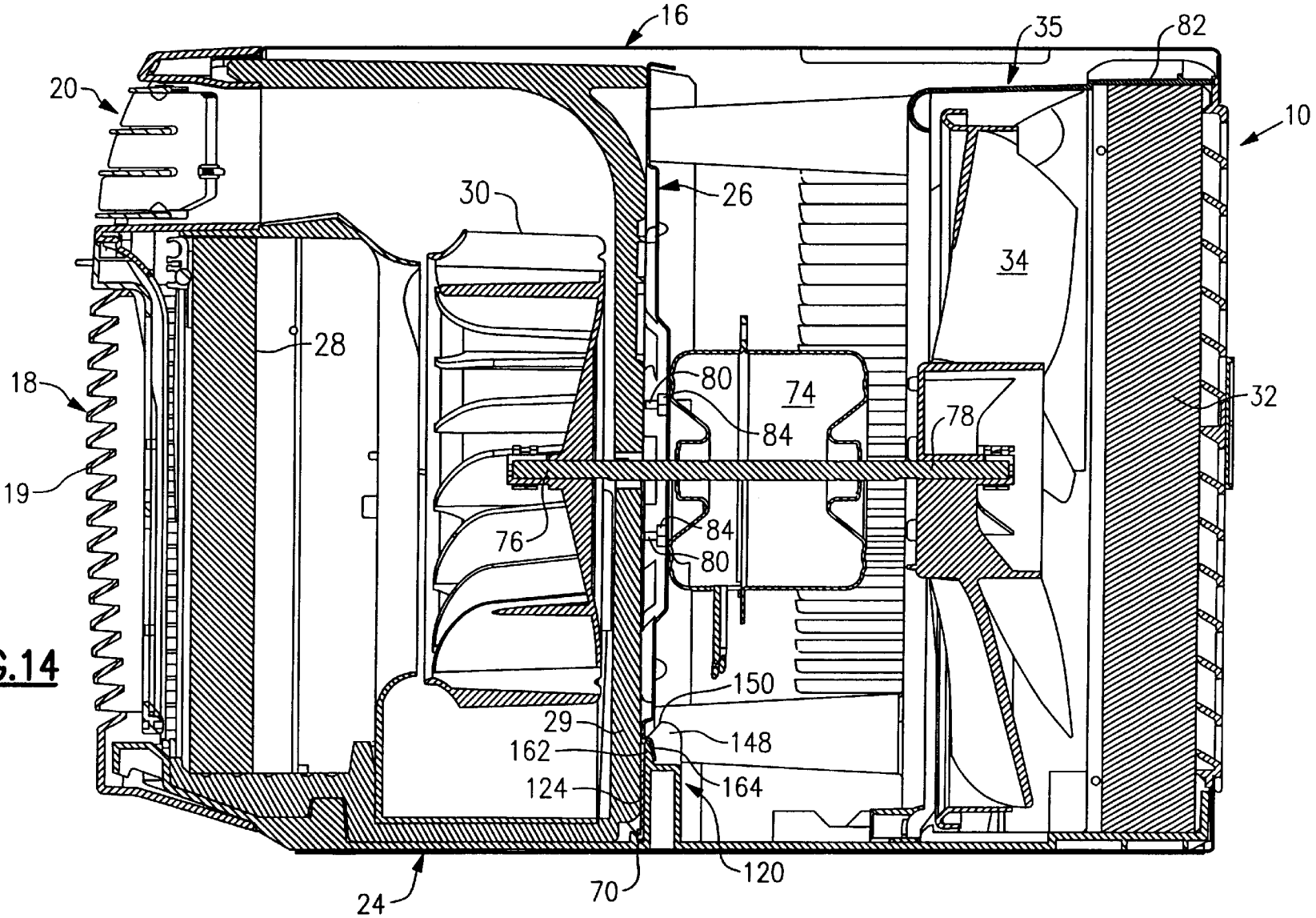

An electric motor 74 having a drive shaft section 76 extending from the front end thereof and a drive shaft section 78 extending from the back side thereof is assembled to the partition 26 by inserting the front shaft section 76 through the opening 64 and passing four mounting bolts 80, integrally formed with the motor, through openings in the recess 62. Appropriate threaded nuts 84 are assembled to the four mounting bolts 80, as illustrated in FIG. 14.

The outdoor fan orifice 35 comprises a one-piece plastic component preferably molded from a 20% talc-filled polypropylene material. The orifice 35 comprises a main body section 86 defining the fan orifice 88 therein. A horizontally extending flange 82 projects rearwardly from the top of the main body section. This flange is configured to overlie and retain the condenser coil, as will be seen. The main body has left and right edges 89 and 91, respectively, which are provided with vertically extending channels which are adapted to engage the tube sheets of the condenser coil 32. Located at the bottom of each of the edges 89 and 91 are left and right mounting conformations 104 and 106, respectively. The left mounting conformation 104 is best seen in FIG. 6, and the right mounting conformation 106 is best seen in FIG. 7. Each conformation is shaped like a "house" and has vertically extending side walls 108 interconnected by inclined top walls 110 at the upper ends thereof. The conformations have an internal back wall cooperating with the top walls 110 to define a converging space configured to receive and guide mating structure 114 formed in the basepan 26.

One of the inclined side walls of each conformation has an outer laterally facing section having an opening 118 formed therein. Extending forwardly from the top of the main body section 86 are a pair of tubular spacers 90, which extend from a large diameter section where they are integrally formed with the main body section to smaller diameter ends 92, which are attached by way of appropriate threaded fasteners to the partition 26.

Assembly of the upper subassembly 38 continues with attachment of the outdoor fan 34 and the indoor fan 30 to the motor shaft sections 78 and 76, respectively.

Looking now at FIGS. 1, 6 and 7, reference numeral 92 generally designates a one-piece component which serves to define the indoor fan orifice, and a portion of the indoor scroll assembly 29. This component 92 will be referred to as the "evaporator orifice 92" and as with the condenser is molded from a talc filled polypropylene plastic material. The evaporator orifice 92 comprises a substantially planar main body section 94 having an opening 95 therein, which is approximately the same diameter as the indoor fan 30. The main body section has left and right-hand edges 98 and 100, respectively, which are provided with vertically extending channels which are adapted to engage the evaporator coil. A horizontally extending flange 96 configured to overlie the evaporator coil projects forwardly from the upper end of the main body section 94. The main body section 94 is attached to the partition 26 by suitable threaded fasteners. A control box 102 is attached to the partition in the upper right-hand corner thereof.

Figure 9:
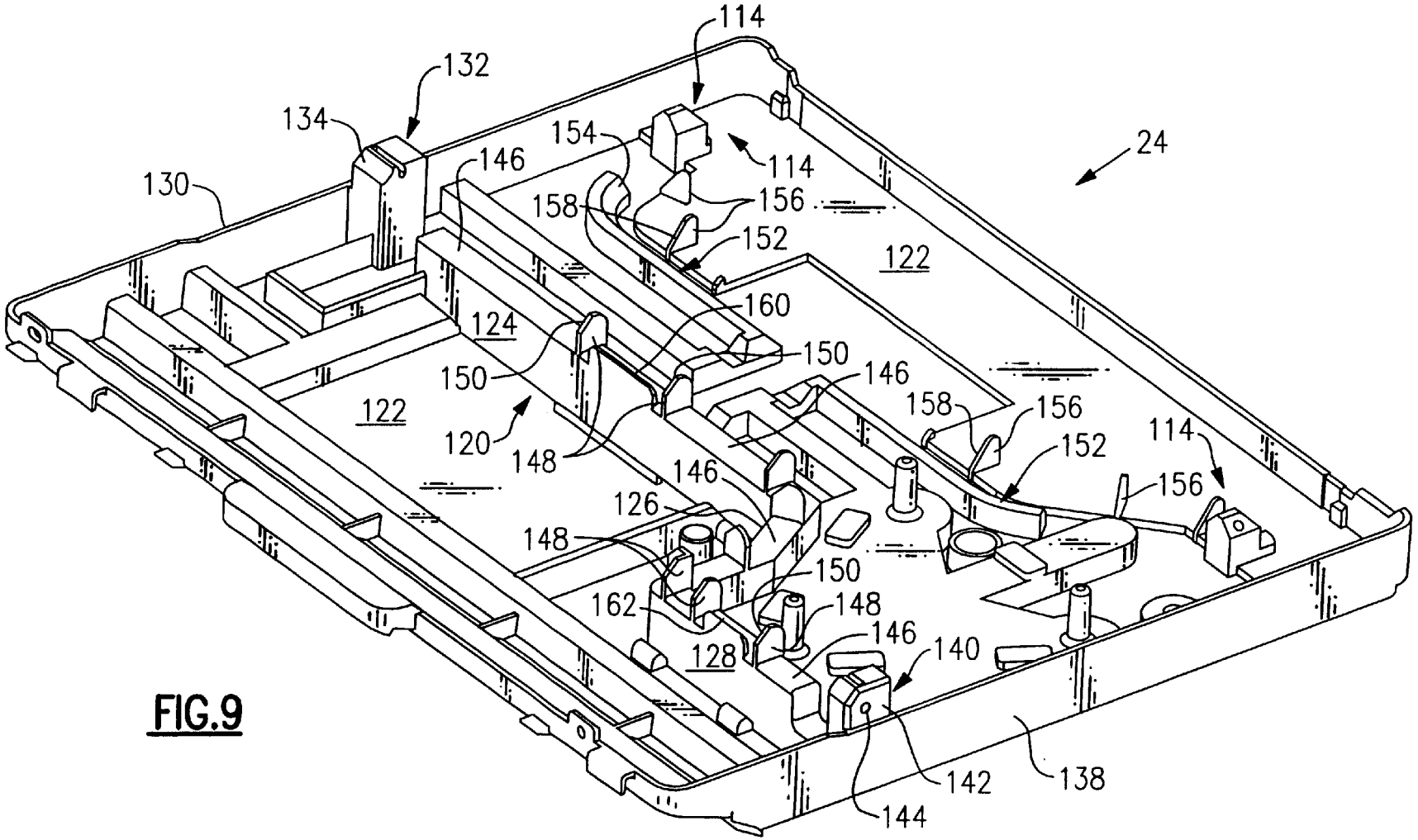
FIG. 9 is a perspective view of the basepan embodying features of the present invention.

The basepan 24, best shown in FIG. 9, is provided with structural features which are configured to cooperate with the partition 26 and the condenser fan orifice structure 35 to render the installation, alignment and attachment of the upper subassembly 38 to the lower subassembly 40 in an efficient manner requiring little possibility of misalignment and requiring minimal manual steps in the actual mechanical attachment of the subassemblies to one another.

The basepan 26 is provided with a transversely extending upstanding structural wall 120, which extends upwardly from the substantially planar bottom wall 122. The structural wall 120 is made from three segments, each of which defines a forwardly facing planar wall section 124, 126 and 128, which are configured to receive in confronting relation thereto the three planar sections 60, 66 and 68 of the partition 26 when the air conditioner is fully assembled. Located to the left of the wall section 124 and integrally formed with a vertically extending left-hand wall 130 of the basepan is a structural boss 132 defining an outwardly facing structural wall 134 having an opening 136 formed therein. In a like manner, extending upwardly from a right-hand wall 138 of the basepan 126 is a second vertically extending structural boss 140 defining an outward facing wall 142 having an opening 144 formed therein.

Each of the wall sections 124, 126 and 128 defines an upper surface generally, 146, and each is provided with several vertically extending guide tabs 148. Each of the guide tabs 148 has an edge 150 formed thereon, which is configured to engage one of the lower rounded edges 70 of the partition walls when the partition is being assembled to the basepan to guide the lower portions of the partition walls into confronting engagement with the lower wall sections.

Located in the rear section of the basepan are a pair of upstanding structural wall sections 152, which are configured to cooperate with the lower edge 149 of the condenser fan orifice assembly 35. Each of these wall sections 152 has an inclined rearwardly upwardly facing wall section 154. Spaced from each of the wall sections 152 are vertically extending guide tabs 156, each of which have an inclined edge 158 facing the inclined guide surfaces of the walls 152. The structure, together, cooperates to receive and guide the lower edge 149 of the condenser orifice into its correct assembled position in contact with the bottom wall 122 of the basepan. Located adjacent the left and right side walls 130 and 138 of the basepan near the rear thereof are the previously mentioned structures 114, which are configured to be received within the left and right mounting conformations 104 and 106 described above.

As thus configured, assembly of the upper subassembly 38 to the lower subassembly 40 is a simple process of vertically aligning the upper subassembly with the components thereof oriented as illustrated in FIGS. 6, 7 and 8 and lowing the upper assembly downwardly, as illustrated in these drawing figures, until the assembly is complete, as illustrated in FIG. 3. During the lowering process, the lower end 70 of the partition 26 engages the edges 150 of the guide tabs 148, which guide the partition into confronting engagement with the forwardly facing wall surfaces 124, 126 and 128 of the transverse extending wall 120. At the same time, the lower edge 149 of the condenser fan orifice structure 35 will be guided into its proper alignment by the inclined edges 158 of the alignment tabs 156 and the inclined walls 154 of the wall sections 152.

Figure 13:
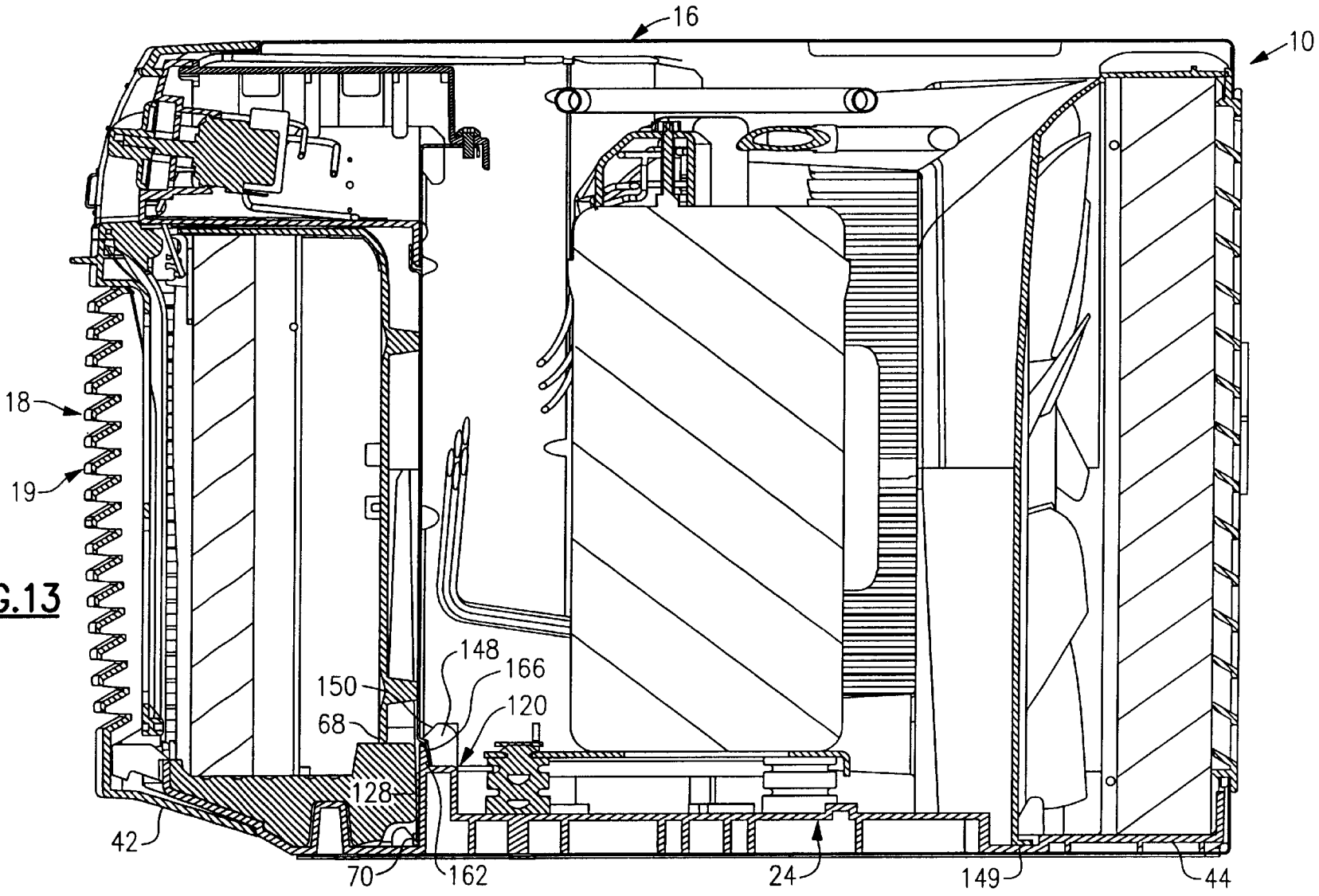
FIGS. 13 and 14 are side sectional views taken through the air conditioning unit of FIG. 1 to illustrate details of the present invention.

It should be noted that a further structural cooperation between the partition 126 and the wall 120 is established by engagement of a pair of vertically extending tabs 160 and 162 formed on the wall sections 124 and 128, respectively. These tabs are configured to be received in mating conformations formed on the partition. Specifically, the tab 160 is received in a conformation 166 formed in the wall section 60 while the vertically extending tab 162 is received in a mating conformation 164 formed in the wall section 68. The engagement of the tab 162 with its mating structure 164 is illustrated in FIG. 14 while the engagement of the tab 162 with its mating structure 166 is illustrated in FIG. 13.

Looking now at FIG. 3, with all of the alignment and support structure in its described cooperation, attachment of the upper subassembly 38 to the lower subassembly 40 is completed by the use of four threaded fasteners, two of which are illustrated in FIG. 3. The first fastener 176 extends through the opening 83 in the right-hand flange 81 of the partition and into the opening 144 in the right-hand supporting boss 140. The second fastener 178 passes through the opening 118 in the inclined wall 110 of the mounting conformation 106 of the orifice structure 35 and into the mating opening formed in the mating structure 114 formed in the basepan. Two other threaded fasteners extend through the corresponding structure on the left-hand side of the air conditioner unit to complete the assembly thereof. It should be noted that the threaded fasteners are easily installed from the right and left-hand sides of the air conditioning unit with no need to extend long cumbersome tools vertically downwardly into the components of the unit to threadably attach flanges or the like between the partition or the shroud 35 to the basepan structure.

What is claimed is:

1. An air conditioner of the type assembled from a first subassembly, which includes:

a basepan having an indoor region proximate the front of the basepan and an outdoor region proximate the back of the basepan;

a compressor supported in the outdoor region;

a condenser coil supported in the outdoor region rearwardly of the compressor;

an evaporator coil supported in the indoor region; and a refrigeration flow circuit interconnecting the condenser coil, evaporator coil and the compressor;

a second subassembly, which includes a vertically extending partition having an indoor side, an outdoor side, and an opening therein extending from the indoor side to the outdoor side, the partition being configured to cooperate with the basepan to separate the indoor region from the outdoor region;

an electric motor mounted on the outdoor side of the partition, the motor having a drive shaft extending perpendicular to the partition with a first end extending through the opening so that it is on the indoor side of the partition and a second end on the outdoor side of the partition;

an indoor fan mounted to the first end of the drive shaft and an outdoor fan mounted to the second end of the drive shaft;

the first subassembly and the second subassembly each being configured such that they may be assembled separate from one another and such that the second subassembly may be assembled to the first subassembly by the positioning the second subassembly in a position vertically spaced above the first subassembly and lowering the second subassembly into a predetermined alignment with the first subassembly with the outdoor fan forward of and adjacent to the outdoor heat exchanger, and the indoor fan rearwardly of and spaced from the indoor heat exchanger, and with the partition engaging said basepan, wherein the improvement comprises:

said partition having a vertically extending lower portion defining a lower edge;

said basepan having a lower wall having formed therein an upstanding structural wall configured to receive said lower portion of said partition in confronting relation therewith with said lower edge in contact with said lower wall.

2. The air conditioner of claim 1 wherein said partition comprises a plurality of sections, each of said plurality of sections having a lower portion defining a lower edge, and wherein said basepan has an upstanding structural wall section configured to receive said lower portion of each of said partition sections in confronting relation therewith with said lower edges in contact with said lower wall.

3. The air conditioner of claim 2 wherein said basepan has left and right side walls extending vertically upwardly from right and left edges of said lower wall, respectively;

said partition has left and right vertically extending flanges formed on left and right edges thereof, said left and right side walls and said left and right flanges being configured to be substantially coplanar with one another; and left and right-hand structural bosses formed with and extending upwardly from said and left and right side walls, respective, said bosses each having an outwardly facing substantially vertical planar surface configured to be in confronting relationship with the inwardly facing side of said left and right flanges, each of said flanges and its associated boss having axially aligned openings therein configured to receive threaded structural fasteners inserted generally laterally therein.

4. The air conditioner of claim 2 wherein each of said upstanding structural wall sections has formed therewith one or more vertically extending guide tabs, each of said guide tabs having an edge formed thereon configured to engage one of said lower edges of said partition when said partition is being assembled to said basepan to guide said lower portion of said partition into confronting engagement with said lower wall sections.

5. The air conditioner of claim 4 wherein said second subassembly further includes an outdoor fan orifice structure attached to said outdoor side of said partition, said orifice structure having an opening therein configured to surround said outdoor fan, said orifice structure having a lower section defining a lower edge configured to engage said lower wall of said basepan;

said basepan having one or more upstanding structural wall sections configured to receive said lower section of said orifice structure in confronting relation therewith with said lower edge in contact with said lower wall.

6. The air conditioner of claim 5 wherein said orifice structure has left and right end walls, each of said left and right end walls having a structurally attached conformation formed thereon at the lower end thereof, each of said structural attachment confirmations defining an inclined outwardly facing wall section having an opening formed therein;

said basepan having two orifice structure mounting bosses formed thereon, which are configured to cooperate with said structural attachment confirmations on said left and right end walls of said orifice plate, said bosses having inclined surfaces formed thereto configured to receive said inclined wall sections of said attachment conformations in confronting relation thereto, said inclined surfaces having openings therein in axial relation with said openings in said bosses to receive threaded fasteners therethrough inserted from a generally lateral direction.

* * * * *